US005799949A

United States Patent [19]

Beall et al.

[11] Patent Number: 5,799,949

[45] Date of Patent: *Sep. 1, 1998

[54] ANNULAR CHAMBER SEAL

[75] Inventors: Clifford H. Beall, Broken Arrow; Michael S. Rawson, Tulsa; Kurt A. Hickey, Broken Arrow, all of Okla.

[73] Assignee: Baker Hughes Incorporated, Houston, Tex.

[ * ] Notice: The term of this patent shall not extend beyond the expiration date of Pat. No. 5,496,044.

[21] Appl. No.: 787,781

[22] Filed: Jan. 23, 1997

Related U.S. Application Data

[63] Continuation of Ser. No. 555,597, Nov. 9, 1995, which is a continuation of Ser. No. 36,345, Mar. 24, 1993, Pat. No. 5,496,044.

[51] Int. Cl.[6] ..... F16J 9/00; F16L 25/00

[52] U.S. Cl. ..... 277/1; 277/59; 277/70; 277/115; 277/236; 166/319; 285/140; 285/333

[58] Field of Search ..... 277/115, 117, 277/236, 1, 170, 171, 59, 70, 110, 144, 167.5; 166/319, 320, 321; 285/140, 141, 142, 143, 351, 334, 332.2, 333, 332, 332.1, 334.2

[56] References Cited

U.S. PATENT DOCUMENTS

| | | | |
|---|---|---|---|
| 3,141,685 | 7/1964 | Watts . | |
| 4,452,310 | 6/1984 | Pringle et al. . | |
| 4,538,838 | 9/1985 | Pringle . | |
| 4,624,488 | 11/1986 | Furgerson . | |
| 4,641,841 | 2/1987 | Regan . | |
| 4,669,547 | 6/1987 | Pringle . | |
| 4,676,529 | 6/1987 | McDonald . | |
| 4,736,967 | 4/1988 | Mott et al. . | |
| 4,749,043 | 6/1988 | Rodenberger . | |
| 4,795,200 | 1/1989 | Tung . | |
| 4,796,705 | 1/1989 | Carmody et al. . | |
| 4,796,928 | 1/1989 | Carlin et al. . | |
| 4,817,962 | 4/1989 | Mott et al. . | |
| 4,862,965 | 9/1989 | Pringle . | |
| 4,941,534 | 7/1990 | Berzin . | |
| 4,944,351 | 7/1990 | Eriksen et al. | 166/317 |
| 5,496,044 | 3/1996 | Beall et al. | 227/236 |

OTHER PUBLICATIONS

Baker Oil Tool Drawing No. 565–446–00 (Apr. 15, 1988).
Baker Oil Tool Drawing No. 565–446–01 (Apr. 15, 1988).
Baker Oil Tools literature on Safty Systems, 1 page, date unknown.
Baxendale & Co. Ltd. Catalogue No. 371, Reprinted, pp. 226–227, date unknown.

*Primary Examiner*—Daniel G. DePumpo
*Attorney, Agent, or Firm*—Rosenblatt & Redano

[57] ABSTRACT

Internal and external metal-to-metal radially interfering seals are provided for an annular chamber. Typically, an annular chamber is used in tubular goods to be part of the hydraulic control circuitry, such as for operating subsurface equipment such as a subsurface safety valve. Resilient seals are eliminated and sealing reliability is enhanced by a design which features metal-to-metal seals internally and externally, preferably assembled by an external two-step thread. The radial interference seal, which is internally disposed, is constructed so as to be incapable of experiencing tensile loads. This reinforces joint integrity by minimizing stresses on thin components.

17 Claims, 3 Drawing Sheets

ANNULAR CHAMBER SEAL

This application is a continuation of application Ser. No. 08/555,591 now abandoned, filed Nov. 9, 1995, which is a continuation of application Ser. No. 08/036,345, filed on Mar. 24, 1993, which issued as U.S. Pat. No. 5,496,044.

FIELD OF THE INVENTION

The field of the invention relates to sealing technology, particularly those seals used in downhole tools for sealing annular chambers.

BACKGROUND OF THE INVENTION

In the past, tubing strings have employed various devices which have needed pressure chambers for actuation of various components. In some of these layouts, a separate connection outside the tubing string is provided for hydraulic control pressure. This pressure is used to selectively actuate a subsurface safety valve, depending on the configuration. Occasionally, the control components in the hydraulic circuit, for actuation of such downhole components as a subsurface safety valve, fail. For example, the hydraulic piston that is actuated by the control circuit, which is in fluid communication with an annular chamber, occasionally sticks or experiences seal failure. When this occurs, it is not possible to use the hydraulic forces in the control circuit to actuate the subsurface safety valve, or some other downhole component as required. When these circumstances occur, it is desirable to lower a substituted component through the tubing and position it appropriately to accomplish the task of the part rendered inoperative due to control circuit failure. At the same time, it is desirable to use the hydraulic control pressure to actuate this newly inserted component in the tubing or wellbore.

When these situations occur, it has become desirable to lower a penetrating tool to the desired depth and bore laterally into the hydraulic control circuit chamber. In order to facilitate the fluid communication into the control circuit, an annular chamber is provided so that upon reaching the proper depth, radial puncture in any direction will assure fluid communication into the annular chamber. Stated differently, if the control circuit flowpath adjacent the tubular were strictly longitudinal, the puncture device would have to be properly oriented so that when it was actuated to perform a radial puncture, it would be in alignment with the longitudinal flowpath of the control circuit.

In the past, sealing annular control circuit chambers has been and continues to be of concern.

Accordingly, one of the objects of the present invention is to provide an annular chamber, such as those used in control circuits where the annular chamber extends in the tubular goods and is sealed internally and externally by metal-to-metal seals. It is a further object of this invention to eliminate resilient seals for sealing annular chambers used in control circuits or other application in tubular goods for downhole use.

SUMMARY OF THE INVENTION

Internal and external metal-to-metal radially interfering seals are provided for an annular chamber. Typically, an annular chamber is used in tubular goods to be part of the hydraulic control circuitry, such as for operating subsurface equipment such as a subsurface safety valve. Resilient seals are eliminated and sealing reliability is enhanced by a design which features metal-to-metal seals internally and externally, preferably assembled by an external two-step thread. The radial interference seal, which is internally disposed, is constructed so as to be incapable of experiencing tensile loads. This reinforces joint integrity by minimizing stresses on thin components.

DETAILED DESCRIPTION OF THE PREFERRED EMBODIMENT

Figure 1:
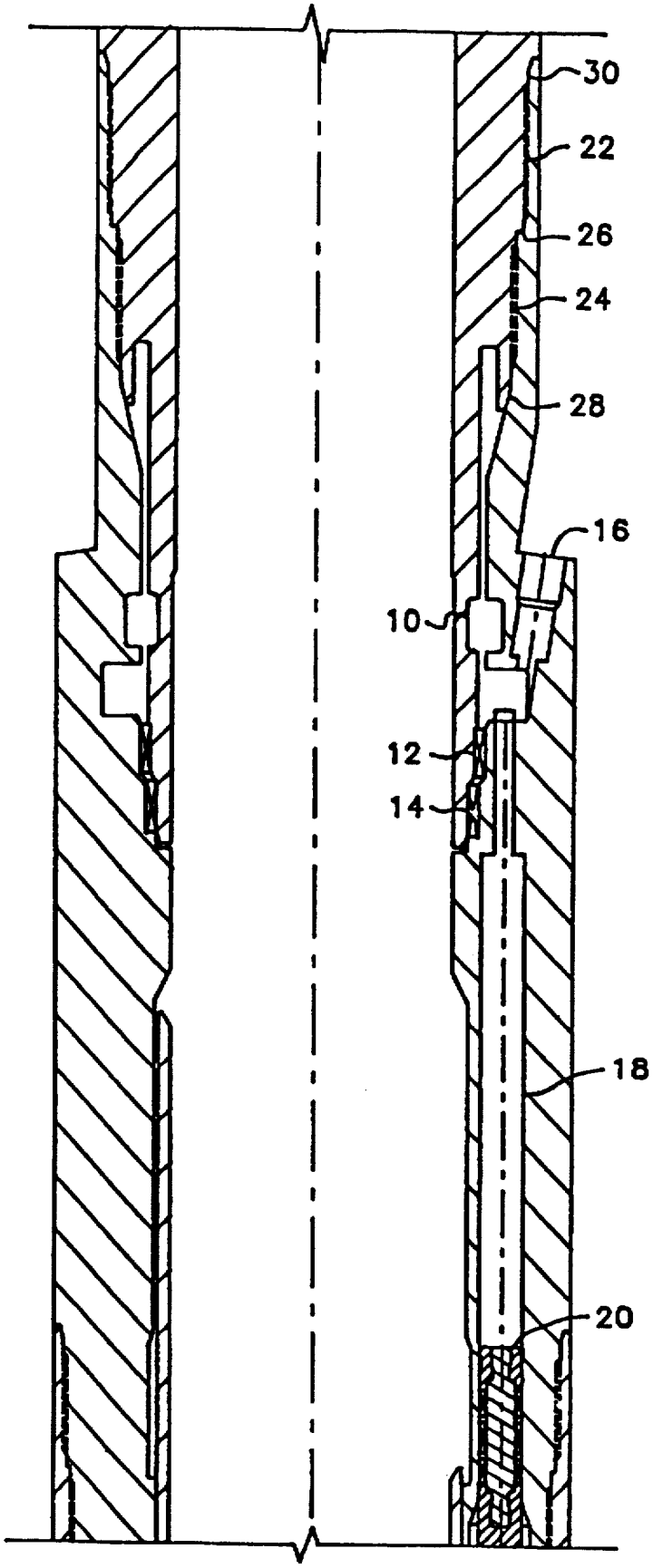
FIG. 1 is an sectional elevational view showing the annular chamber with a sealing assembly using resilient seals.

FIG. 1 illustrates the annular chamber with a sealing assembly. There, an annular chamber 10 is internally sealed by resilient seals 12 and 14. A connection 16 is provided to allow introduction of control hydraulic pressure. The hydraulic pressure enters chamber 10 and flows through passage 18 until it reaches piston 20. The movement of piston 20 can be used to actuate a downhole component, such as a subsurface safety valve. Threads 22 and 24 in conjunction with sealing surfaces 28 and 30 have been used for external seals for chamber 10. This two-step thread employed a torque shoulder 26 and opposed sealing surfaces 28 and 30.

Figure 2:
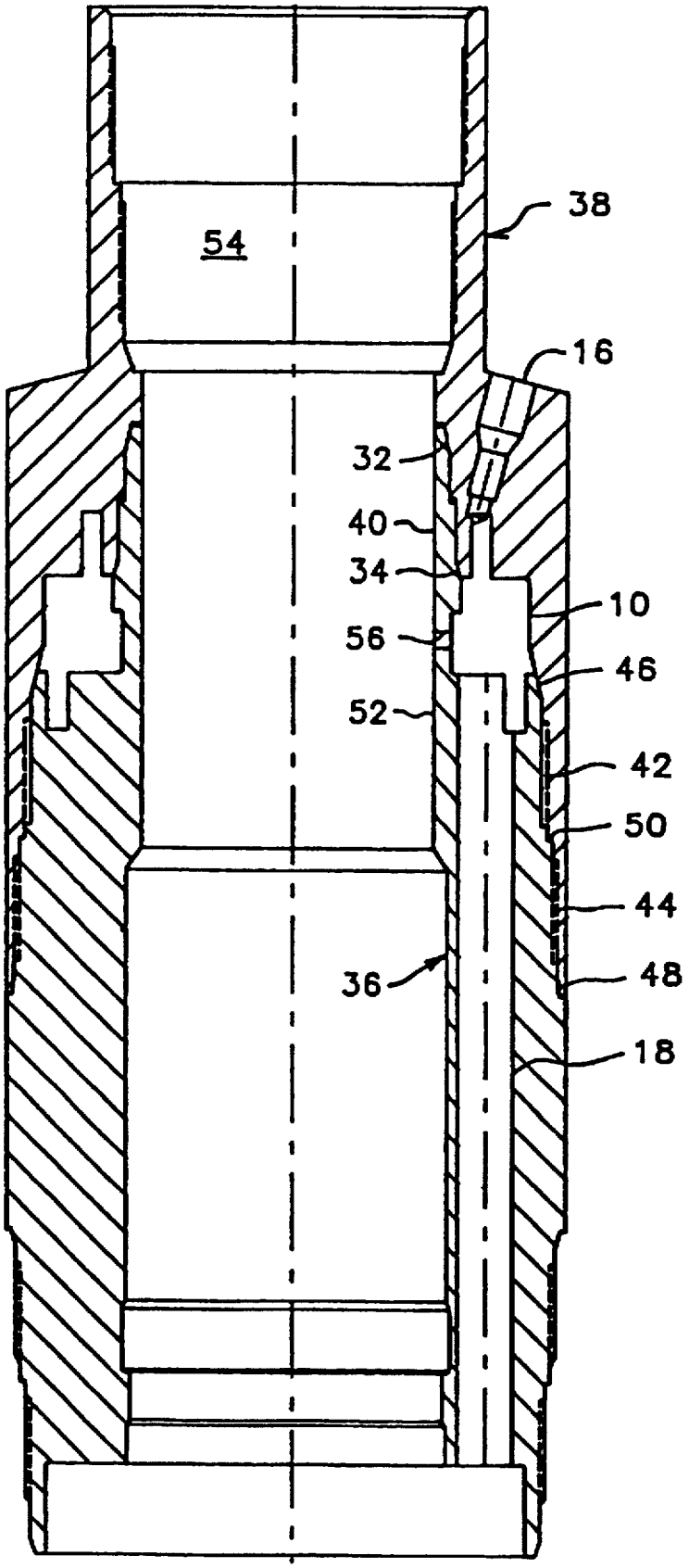
FIG. 2 is a sectional elevational view of the apparatus of the present invention showing the annular pressurized chamber with internal and external metal seals.

The apparatus of the present invention, as shown in FIG. 2, still has the connection 16 leading into the chamber 10. Chamber 10 is in flow communication with passage 18 for actuation of subsurface component, such as a subsurface safety valve, by pressure applied to connection 16. The internal seals for chamber 10 comprise opposed surfaces 32 and 34. In a preferred embodiment, there is radial interference between the pin 36 and the box 38. The upper end 40 of pin 36, due to the absence of threads, is incapable of being subjected to tensile loads. This is significant because upper end 40 is a thin-walled component of pin 36 and could be subject to fracture under tensile loads following radial puncture. In order to provide the interference force that keeps mating surfaces 32 and 34 together, a two-step thread 42 and 44 is employed. The two-step thread 42 and 44 has a form known to those skilled in the art and further comprises a pair of sealing surfaces 46 and 48. A torque shoulder 50 assists in the makeup of the two-step thread 42 and 44. The thread form of threads 42 and 44 can be overhung so that, in conjunction with the torque shoulder 50, the sealing surfaces 46 and 48 are drawn to their opposed surface. There is a preferably slight interference fit radially for the paired surfaces 46 and 48. In the preferred embodiment, the sealing surfaces 32, 34, 46, and 48 are slightly tapered in the range of 0°–20° from the longitudinal axis of the pin 36 and box 38.

Another feature of the apparatus of the present invention is the configuration of chamber 10. Chamber 10 has a thin-walled section 52. This facilitates the radial puncture procedure by providing a thin wall 52 for the puncture apparatus. As a result, the puncture procedure can be concluded more quickly since there is less metal to penetrate. At the same time, the inner wall of the pin 36 has sufficient structural rigidity to withstand the desired interference fit radially at mating surfaces 32 and 34, as well as the expected internal pressures in chamber 10.

Figure 3:
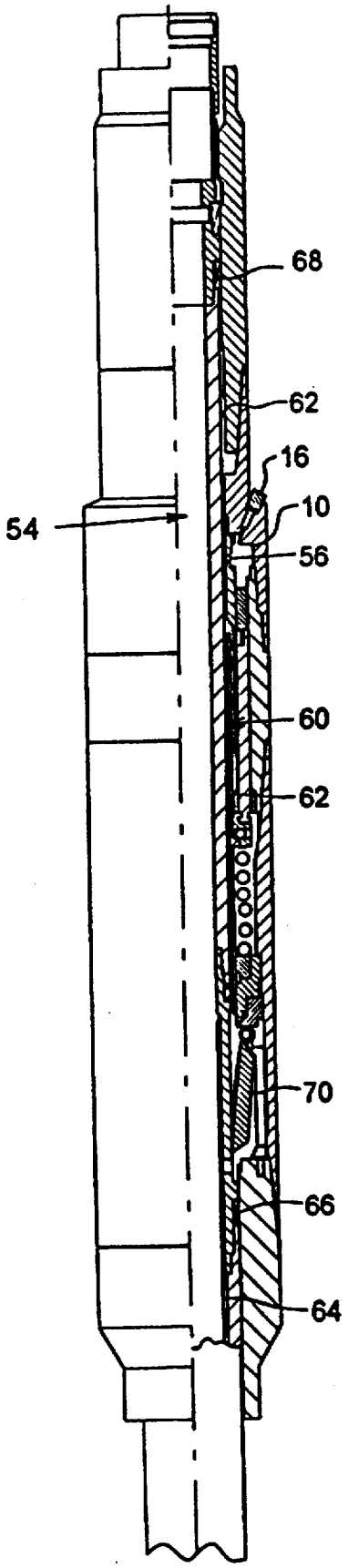
FIG. 3 shows the operation with an insert valve installed after penetration into the chamber.

Referring now to FIG. 3, an insert valve 60 is lowered into bore 54. Valve 60 latches on to bore 54 in the customary manner such as using locking collets in a manner well-known in the art. With chamber 10 punctured to create port 56, the insert valve 60 may be operated by applying pressure at inlet 16, which flows through a channel 62 to a piston 64. Seals 66 seal off the lower end of passage 62. Additionally, seals 68 seal off passage 62 at the upper end. Accordingly, pressure applied to inlet 16 is communicated against piston 64 to actuate its movements so that the valve 60 can continue to operate using the control circuit pressure communicated through chamber 10. The insert valve 60 takes the place of subsurface safety valve 70, which is pushed out of the way upon insertion of the insert valve 60.

Normally, the subsurface components are actuated by a control circuit pressure applied at connection 16. Typically, the applied pressure at port 16 actuates a piston which in turn ties into the final controlled component (not shown). However, if for any reason, the piston (such as 20 shown in FIG. 1) fails to operate and another replacement component is inserted through the bore 54, it is desirable to redirect the pressure in the control circuit from chamber 10 directly into the newly installed component. Those skilled in the art will appreciate that the replacement component inserted through the bore 54 has its own actuating mechanisms responsive to hydraulic pressure. At that point in time with thin wall 52 having been penetrated by a penetrating tool, the control circuit pressure in chamber 10 is redirected into the replacement component. The replacement component (not shown) straddles the opening 56 which is placed there as a result of the operation of the penetrating tool. Thereafter, the replacement downhole component can be actuated using pressure applied at port 16. Now, instead of directing the pressure downwardly through passage 18, the pressure is redirected through opening 56 into the replacement subsurface component so that it can be actuated and operations resumed.

It can be seen that internal pressure applied in bore 54 also urges the sealing surfaces 32 and 34 into greater contact, thus promoting the internal seal of chamber 10.

The elimination of the flexible seals, is a significant improvement in reliability of these critical joints that are part of the hydraulic circuit for key downhole components. Unreliability in the sealing of the joints in the control circuit, such as at chamber 10, can adversely effect the longevity of the control system. By virtue of the addition of the internal and external metal seals, reliability has been approved. Assembly has also been facilitated since in the past the resilient seals, such as cup-shaped seals, were extremely difficult to install without doing damage to the seals during assembly. With the metal-to-metal seals internally and externally, assembly has been greatly facilitated as it is now guided by the two-step thread 42 and 44.

In another feature of the present invention, a method has been developed to create a pin 36 and box 38 arrangement so that an annular cavity is created, with the annular space sealed internally and externally with metal-to-metal seals. The method of the present invention overcomes the prior problem in attempting to build such an apparatus because there previously did not exist the means of economically controlling the needed metal-to-metal interferences so that the seals could be reliably created internally and externally to the annular chamber. The proper amount of interference is important to ensure sealing integrity. However, too much interference can tend to create galling and prevent the easy assembly of the joint. Due to the close manufacturing tolerances required, construction of annular chambers with metal-to-metal internal and external seals have not been commercially available in the past. The threaded connection 42 and 44 has a center locating shoulder 50 which carries the torque of the made-up connection. The shoulder 50 also positions the contacting surface 32 and 34 on the pin nose 40 and the mating opposed surfaces in the box, as well as on the other end involving the contacting surfaces 46 and 48 on the box nose and its mating surface on the pin. In the preferred embodiment, the pin and box are made so as to have radial interference of about 0.0025 inch per inch of diameter. It has generally been found that lesser degrees of interference do not provide for an adequate seal, while substantially greater interference presents a hazard of galling. The pin 36 and box 38 are designed such that the pin nose is thin-walled but abuts the relatively thick main section of the box 38. Therefore, internal pressures in bore 54 actually promote internal sealing, while the substantial thickness of box 38 adjacent pin nose 40 provides the structural rigidity for the internal sealing. The same concept applies on the external joint at sealing surfaces 46 and 48. While the box nose is relatively a thin-walled member, it is mounted opposite the thick-walled portion of the pin. Accordingly, external pressures in the annulus applied to the pin 36 and box 38 promote sealing externally at sealing surfaces 46 and 48.

The method of the present invention applies a technique wherein the pin and box are manufactured using the same baseline dimensions. The manufacturing baseline dimension is taken from the torque shoulder 50 on both the pin and box. Based on this starting dimension, the extension portion is developed which includes sealing surfaces 32 and 34. Since the base dimension is taken from shoulder 50, the exact location of mating surfaces 32 and 34 can be positioned with the desired amount of interference in a manufacturing process that allows for specific control of the tolerances. This ensures that the proper amount of the desired radial interference is built into the pin 36 and the box 38 such that when they are put together, there will be sufficient force to ensure the seal yet an interference amount short of a situation where galling can occur. The pin nose 40 is not manufactured with a torque shoulder due to the difficulty in manufacturing tolerances of having two torque shoulders seat simultaneously. The torque shoulder 50, along with precise control of the dimensions of the pin nose 40 and the mating portions of box 38, removes the need for an internal torque shoulder or threads. However, the base reference technique using torque shoulder 50 or another starting reference point can be employed to optionally produce a pin/box joint involving an annular space in between, with an internal as well as external torque shoulder. Through the use of a common reference point, the particular interference range at the pin nose is accomplished by dimensional control of the surfaces adjacent the pin nose. Since a common reference point is used for the mating surfaces adjacent the pin nose, the tolerance spread of mating surfaces 32 and 34 can be controlled to within the same tolerance as the mating surfaces 46 and 48.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for isolating a chamber from at least one of pressures internal to the apparatus and pressures applied externally to the apparatus, said apparatus defining a tubularly shaped wall containing a chamber, said chamber comprising a portion of a downhole fluid-actuated system, comprising:

an elongated housing comprising a threaded pin and a threaded box tubular components, said components when threaded together forming a wall, said wall having an interior and exterior face and defining an annular chamber therein and at least one passage running in said wall in communication with said chamber and serving as part of a pressurized fluid-actuated downhole control system;

at least one internal seal to prevent at least one of flow into said chamber from pressure against said internal face and pressure in said chamber from escaping past said interior face;

at least one external seal to prevent at least one of flow into said chamber from pressure against said external face and pressure in said chamber from escaping past said exterior face;

said chamber disposed in said housing in communication with said seals; and said internal and external seals formed by metal-to-metal contact between said housing components, whereupon threading of said housing components, fluid pressure can be communicated through said chamber and said passage for operation of a fluid-actuated control system.

2. The apparatus of claim 1, wherein:

said internal seal is formed by a radial interference fit between said housing components; and said chamber extending annularly within said wall.

3. The apparatus of claim 2, wherein said internal seal comprises a plurality of radial interference seals.

4. A sealing system against internal and external pressures applied to an annular chamber in a downhole tubular forming a part of a fluid-actuated system, comprising:

an elongated housing having a bore therethrough and forming an annular chamber formed in a wall thereof, said wall having an internal face exposed to said bore and an external face forming the outside of the downhole tool, said wall further forming at least one passage therethrough, independent of said bore and in communication with said chamber as a part of a pressurized fluid control system through said wall;

said housing composed of a threaded pin and a threaded box members, said chamber formed between said pin and box members when threaded together;

at least one internal seal exposed to said bore and said chamber, comprising of a metallic component of said pin engaging a metallic component of said box;

at least one external seal exposed to said chamber and said external face formed by metallic component contact between said pin and said box;

said internal seal disposed on an opposite side of said chamber from said external seal.

5. The sealing system of claim 4, wherein said internal seal comprises a radial interference fit.

6. A method of sealing a chamber in a wall of a downhole tubular against internal and external applied pressures, comprising:

forming a threaded tubular pin and a threaded tubular box member so that when threaded together, a chamber is formed in a wall defined by said threaded together pin and box members;

providing an internal metal-to-metal seal for said chamber, between said pin and box;

threading said pin and box to form said internal seal;

providing an external metal-to-metal seal due to said connection;

disposing said internal seal on the opposite side of said chamber from said external seal;

providing at least one passage in said wall in fluid communication with said chamber;

connecting said passage in a fluid control system independent of an internal bore formed by said wall.

7. The method of claim 6, further comprising:

providing at least an interference fit for said internal metal-to-metal seal.

8. The method of claim 7, further comprising:

minimizing the potential of longitudinal stresses on the thinner wall pin end adjacent said internal seal.

9. A sealing system for an annular passage in a downhole tool, comprising:

an elongated housing having a bore therethrough and forming an annular chamber;

said housing composed of threaded pin and box members;

at least one internal seal exposed to said bore and said chamber, comprising of a metallic component of said pin engaging a metallic component of said box;

said internal seal comprises a radial interference fit;

said metallic components comprising said internal seal are unrestrained longitudinally to minimize stresses due to applied forces in a direction parallel to said bore;

at least one external seal exposed to said chamber and to outside the downhole tool which is on the opposite side of said threaded pin and box members than said bore, said external seal formed by metallic component contact between said pin and said box;

said threaded pin and box members further comprising at least one passage therethrough in fluid communication with said chamber to allow said chamber to function in a pressurized fluid control system, independent of said bore.

10. An apparatus for downhole use, comprising:

a pin member and a box member joinable by mating threads to form an internal bore and an annular chamber therebetween;

at least one seal to prevent pressure in said bore or from outside said threaded pin and box from entering said chamber;

said pin and box members, when threaded together, defining an internal wall which defines at least a portion of said internal bore and said chamber, said internal wall formed being thin to facilitate radial penetration from said bore into said chamber;

said chamber in flow communication through one of said threaded pin and box member with at least one passage in a pressurized fluid control system, said passage being distinct from said internal bore, for normal operation of said pressurized fluid control system;

whereupon said thin wall selectively facilitates an additional entry into said chamber for alternative operation of the fluid control system.

11. The apparatus of claim 10, wherein said seal to keep internal bore fluids out of said chamber is formed in part by said thin wall.

12. The apparatus of claim 11, wherein said thin wall is part of a metallic interference fit between said pin and said box to form said seal.

13. The apparatus of claim 12, wherein said thin wall is of a sufficient thickness to withstand said interference fit and applied internal pressures in said chamber.

14. The apparatus of claim 13, wherein:

said pin and box joined by an internal and external seal with said chamber therebetween;

said seal comprises a metal interference fit internally and externally to isolate fluid internal and external of said joined pin and box from entry into said chamber.

15. The apparatus of claim 14, wherein said internal seal is longitudinally displaced from said external seal with said chamber in between to allow said thin wall to form part of said chamber.

16. The apparatus of claim 10, wherein:

said pin and box are joinable by longitudinally displaced internal and external seals;

said chamber is disposed therebetween to allow said thin wall to form a part of said chamber.

17. A method of providing access to a fluid control circuit through a tubular, comprising:

fabricating a threaded pin and a threaded box;

threading said pin to said box;

creating an annular chamber by said threading;

creating an internal bore by said threading:

creating at least one seal for said chamber by said threading;

providing a thin wall to separate said internal bore from said chamber.

* * * * *